US007003239B2

(12) United States Patent
Tanaka

(10) Patent No.: US 7,003,239 B2
(45) Date of Patent: Feb. 21, 2006

(54) IMAGE FORMING APPARATUS AND FIXING TEMPERATURE CONTROL METHOD FOR THE APPARATUS

(75) Inventor: Hiroshi Tanaka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 67 days.

(21) Appl. No.: 10/731,902

(22) Filed: Dec. 10, 2003

(65) Prior Publication Data

US 2004/0165904 A1 Aug. 26, 2004

(30) Foreign Application Priority Data

Dec. 16, 2002 (JP) ..... 2002-364178
Dec. 16, 2002 (JP) ..... 2002-364179
Jan. 10, 2003 (JP) ..... 2003-003899

(51) Int. Cl.
*G03G 15/20* (2006.01)

(52) U.S. Cl. ..... 399/69; 399/68; 399/400

(58) Field of Classification Search ..... 219/216; 399/67, 69, 320, 330, 68, 400
See application file for complete search history.

(56) References Cited

U.S. PATENT DOCUMENTS 5,701,554 A 12/1997 Tanaka et al.
6,453,130 B1 * 9/2002 Richtsmeier ..... 399/69
6,633,737 B1 10/2003 Tanaka et al.

FOREIGN PATENT DOCUMENTS

| | | | |
|---|---|---|---|
| EP | 1 160 632 | A1 | 12/2001 |
| JP | 7-334023 | A | 12/1995 |
| JP | 3121495 | B2 | 12/2000 |
| JP | 2001-290331 | A | 10/2001 |
| WO | WO 01-35169 | A1 | 5/2001 |

* cited by examiner

*Primary Examiner*—Hoang Ngo
(74) *Attorney, Agent, or Firm*—Sughrue Mion, PLLC

(57) ABSTRACT

A temperature control operation for a fixing device is performed based on a vertical synchronous signal Vsync periodically outputted in association with a cycling motion of an intermediate transfer belt. Furthermore, the temperature control operation provides a constant time difference Δt1 between a leading edge of the vertical synchronous signal Vsync and a start of energization of a heater. Therefore, a period of the vertical synchronous signal Vsync coincides with a period of the temperature control operation corresponding to each vertical synchronous signal Vsync. In addition, a constant time period is provided between the start of energization and an actual arrival of a recording medium at a nip and hence, the temperature of a heating roller can be maintained at an optimum level during the passage of the recording medium through the nip.

20 Claims, 12 Drawing Sheets

IMAGE FORMING APPARATUS AND FIXING TEMPERATURE CONTROL METHOD FOR THE APPARATUS

BACKGROUND OF THE INVENTION

1. Field of the Invention

The present invention relates to an image forming apparatus adapted to fix a toner image to a recording medium by heating a toner borne on a recording medium as the toner image, as well as to a temperature control method for a fixing device of the image forming apparatus.

2. Description of the Related Art

The image forming apparatuses such as printers, copiers and facsimiles provide a permanent image on a recording medium, such as a paper sheet or a transparent sheet. The permanent image is provided by making a powder toner to adhere to the recording medium, in correspondence to an image to be formed, and then fusing the toner to the recording medium by applying heat thereto. As a fixing device of this type, there have heretofore been proposed various forms of devices, the commonest one of which is called a device of a fixing roller system (for example, a fixing device included in an image forming apparatus disclosed in Japanese Patent Publication No.3121495). In this system, the recording medium is passed through a nip between a heating roller heated to a predetermined temperature and a pressurizing roller for application of heat and pressure to the toner, thereby fixing the toner to the recording medium.

Further, the image forming apparatuses of this type include those which forms a color toner image by superimposing toner images of multiple different colors (e.g., yellow, magenta, cyan and black) on top of each other on an intermediate transfer medium rotatingly moved in a predetermined direction and then, transfers and fixes the resultant color toner image to the recording medium (for example, an image forming apparatus disclosed in Japanese Patent Application Laid-Open Gazette No.2001-290331). In this image forming apparatus, the toner images of yellow, magenta, cyan and black are sequentially formed on a photosensitive member. The individual toner images are primarily transferred to an intermediate transfer belt in a manner to be superimposed on top of each other on the intermediate transfer belt whereby the color toner image is formed on the intermediate transfer belt. The color toner image thus formed is secondarily transferred to the recording medium delivered from a cassette and then is delivered to a fixing device which, in turn, thermally fixes the color toner image on the recording medium.

The fixing device provided in such an image forming apparatus need to stabilize the temperature of the heating roller in a predetermined range in order to achieve a good fixing performance. Hence, a temperature control of the heating roller is performed by regulating the amount of electric power supplied to a heating element for heating the heating roller. More specifically, the temperature of the heating roller is sensed and a time period (duty) of energizing the heating element is determined based on the sensing result, the energization time period included in one cycle of a given control period (e.g., 1 second).

More recently, there is an increasing demand for faster image forming lower power consumption, which involves even further reduction of warm-up time (time required for temperature to reach a level to permit fixing) and power consumption of the fixing device. There is a tendency to use a heating roller having a relatively smaller heat capacity in order to meet such a demand. However, the reduction of the heat capacity of the heating roller entails a problem that the heating roller suffers relatively greater fluctuations of its temperature. Particularly when a recording medium at a low temperature (about room temperatures) is fed into the fixing device, the heating roller of the small heat capacity encounters an abrupt temperature drop. Consequently, image defects such as fixing failure and density variations may be produced, or the recording medium may be degraded due to overheating. That is, the fixing device may fail to achieve the good fixing performance.

On the other hand, the aforesaid image forming apparatus capable of forming a color image is provided with a sensor for detecting a reference position of the intermediate transfer belt. The apparatus utilizes a synchronous signal outputted from the sensor for superimposing the toner images of the multiple colors on top of each other as registering the images with one another. Specifically, the apparatus forms each toner image on the photosensitive member at each output of the synchronous signal from the sensor in a predetermined timing and then, primarily transfers the resultant toner image onto the intermediate transfer belt rotated at a given transport speed in synchronism with the photosensitive member. The apparatus controls the registration of the toner images during the primary transfer thereby achieving an accurate superimposition of the toner images of the multiple colors. Furthermore, the recording medium is delivered to a secondary transfer position based on the above synchronous signal so that a color toner image is secondarily transferred thereto. Therefore, so long as the intermediate transfer belt is rotatingly moved at a constant speed, the synchronous signal is outputted in a constant period. Hence, the formation of the toner image, the delivery of the recording medium and the secondary transfer of the toner image to the recording medium are carried out regularly.

In a practical image forming apparatus, however, a secondary transfer roller for performing the secondary transfer in a proper timing, a cleaner blade for cleaning a belt surface or the like temporarily abuts against the intermediate transfer belt during the formation of the color image. The abutment may interfere with the rotary transportation by the intermediate transfer belt, or cause elastic elongation of the intermediate transfer belt or similar elastic deformation of a drive system (such as a gear and a belt) for transmitting power to the intermediate transfer belt. Furthermore, the abutment applies a load to a belt drive section for driving the intermediate transfer belt into rotation. Hence, the intermediate transfer belt becomes incapable of being rotatingly moved at a constant speed due to the abutment or disengagement of such a component. As a result, a pre-fixing operation to be carried out prior to a fixing operation is carried out at an irregular time, the pre-fixing operation including the formation of the toner image, the delivery of the recording medium, the secondary transfer of the toner image to the recording medium and the like.

In a case where a conventional temperature control method providing a fixing temperature control in a constant period is directly applied to the aforementioned image forming apparatus, mismatch between the pre-fixing operation and the fixing operation may again cause the image defects such as fixing failure and density variations or the degradation of the recording medium due to overheating.

SUMMARY OF THE INVENTION

A first object of the invention is to provide a control to stabilize the fixing temperature of the image forming apparatus for accomplishing the good fixing performance. A second object of the invention is to provide an image forming apparatus adapted to achieve the good fixing performance by providing the control to stabilize the fixing temperature, the image forming apparatus which transfers, to the recording medium, the color toner image formed on the intermediate transfer medium such as the intermediate transfer belt and then, fixes the color toner image to the recording medium by heating the toner, carried on the recording medium as forming the color toner image, by means of heating means.

For achieving the above objects, the invention is characterized in that the fixing temperature control of the apparatus or more specifically an energization control of the heating means disposed to heat the toner on the recording medium is performed based on a timing signal associated with a timing of delivering the recording medium to the fixing device.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

The following description is made on five embodiments of an image forming apparatus to which the invention is applied. These embodiments all have the same apparatus arrangement but differ from one another in temperature control method for fixing unit which will be described hereinlater. Hence, the apparatus arrangement common to the embodiments is first explained and thereafter, the fixing temperature control method will be described in each of the embodiments.

<Arrangement of Apparatus>

Figure 1:
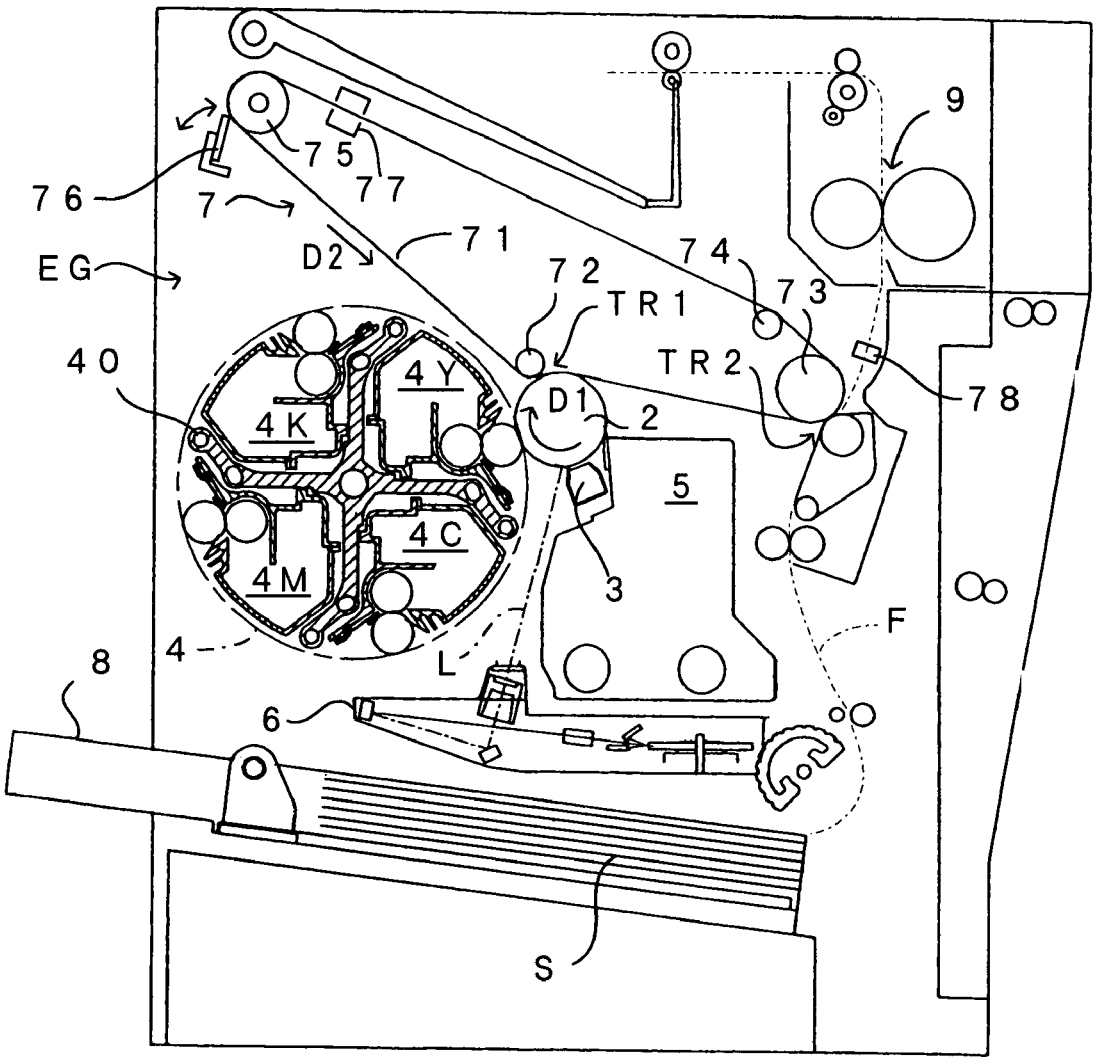
FIG. 1 is a diagram showing an image forming apparatus according to the invention.
Figure 2:
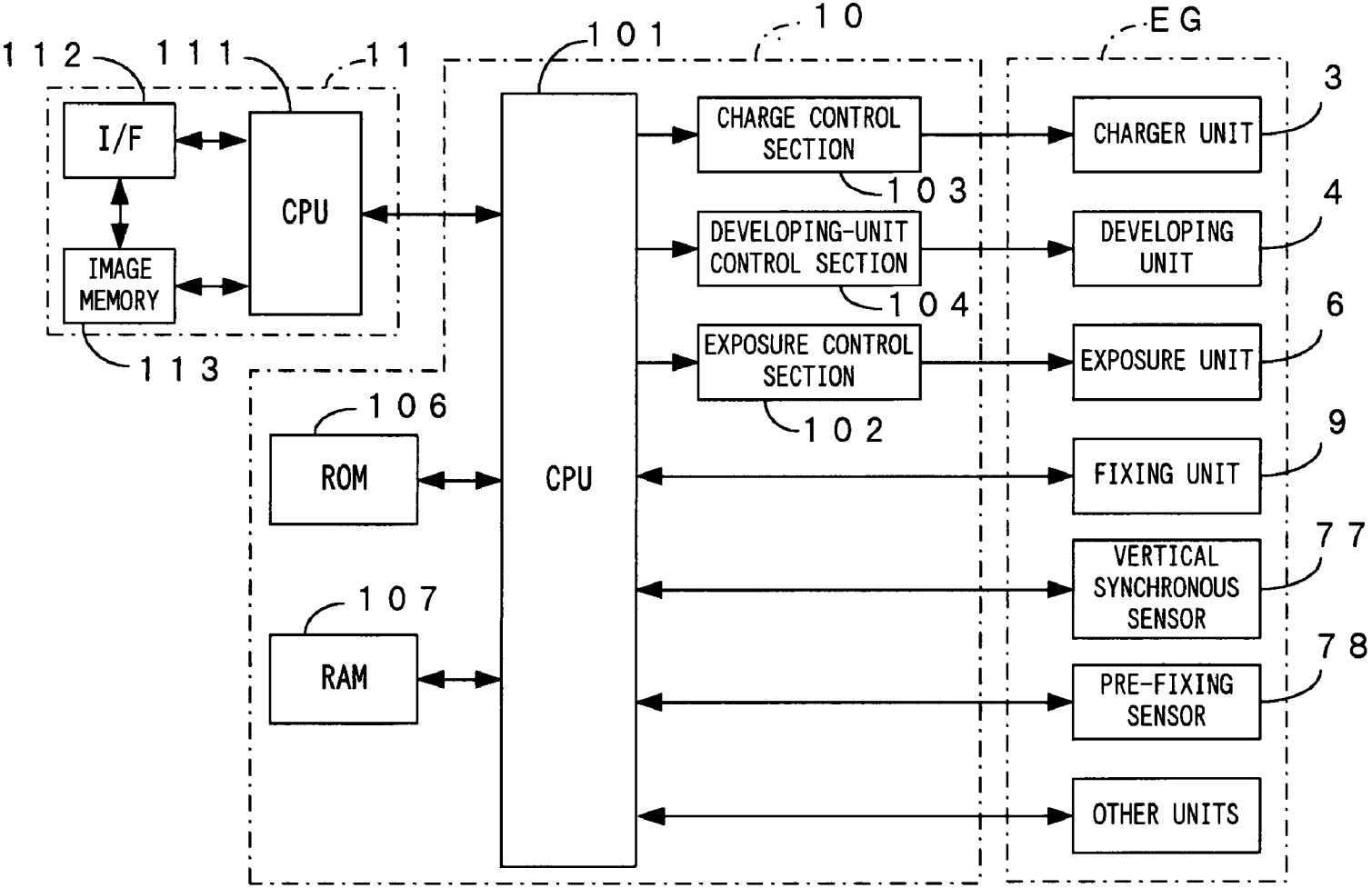
FIG. 2 is a block diagram showing an electrical arrangement of the image forming apparatus of FIG. 1.

FIG. 1 is a diagram showing an image forming apparatus according to the invention, whereas FIG. 2 is a block diagram showing an electrical arrangement of the image forming apparatus of FIG. 1. The apparatus is adapted to form a full-color image by superimposing images of four colors including yellow (Y), cyan (C), magenta (M) and black (K) on top of each other, or to form a monochromatic image using a black (K) toner alone. The image forming apparatus operates as follows. According to the image forming apparatus, when an external apparatus such as a host computer in response to a user demand for forming an image supplies an image signal to a main controller 11, an engine controller 10 responds to a command from the main controller 11 so as to control individual portions of an engine EG whereby an image corresponding to the image signal is formed on a sheet S.

The engine EG includes a photosensitive member 2 rotatable along a direction of an arrow D1 as seen in FIG. 1. A charger unit 3, a rotary developing unit 4 and a cleaning section 5 are disposed around the photosensitive member 2 and along the rotation direction D1. The charger unit 3 is applied with a charging bias from a charge control section 103 so as to uniformly charge an outer periphery of the photosensitive member 2 to a predetermined surface potential.

An exposure unit 6 irradiates a light beam L onto the outer periphery of the photosensitive member 2 thus charged by the charger unit 3. The exposure unit 6 irradiates the light beam L on the photosensitive member 2 according to a control command given by an exposure control section 102 thereby forming on the photosensitive member 2 an electrostatic latent image corresponding to the image signal. When the external apparatus such as the host computer applies the image signal to a CPU 111 of the main controller 11 via an interface (I/F) 112, for example, a CPU 101 of the engine controller 10 outputs a control signal corresponding to the image signal to the exposure control section 102 in a predetermined timing. In response to the control signal, the exposure unit 6 irradiates the light beam L on the photosensitive member 2 for forming thereon the electrostatic latent image corresponding to the image signal.

The electrostatic latent image thus formed is developed with a toner by means of the developing unit 4. The developing unit 4 according to the embodiment includes a support frame 40 rotatable about an axis; an unillustrated rotary drive section; and a yellow developer 4Y, a cyan developer 4C, a magenta developer 4M, and a black developer 4K which are designed to be removably attachable to the support frame 40 and each contain therein a toner of a respective color. As shown in FIG. 2, the developing unit 4 is controlled by a developing-unit control section 104. The developing unit 4 is driven into rotation based on a control command from the developing-unit control section 104. In the meantime, any one of the developers 4Y, 4C, 4M and 4K is selectively positioned at a predetermined development position to abut against the photosensitive member 2 or to face the photosensitive member via a predetermined gap therebetween for applying a toner of a selected color to a surface of the photosensitive member 2. Thus, the electrostatic latent image on the photosensitive member 2 is developed into a visible image of the selected toner color.

The toner image thus developed by the developing unit 4 is primarily transferred onto an intermediate transfer belt 71 of a transfer unit 7 in a primary transfer region TR1. The transfer unit 7 includes the intermediate transfer belt 71 which runs across a plurality of rollers 72–75, and a driver (not shown) for driving the roller 73 into rotation thereby rotating the intermediate transfer belt 71 in a predetermined rotational direction D2. In a case where a color image is transferred to a sheet S, the color image is formed by superimposing the toner images of the respective colors on top of each other on the intermediate transfer belt 71, the toner images formed on the photosensitive member 2. Then, the color image is secondarily transferred onto the sheet S as a "recording medium" taken out from a cassette 8 and transported along a transport path F to a secondary transfer region TR2. The sheet S with the color image thus formed thereon is transported via a fixing unit 9 to a discharge tray disposed at an upper part of an apparatus body. The fixing unit 9 functions as a "fixing device" of the invention, the structure and function of which will be specifically described hereinlater. Thus, the engine EG functions as "image forming means" according to the invention.

On the other hand, a cleaner 76 and a vertical synchronous sensor 77 are disposed in the vicinity of the roller 75. Of these, the cleaner 76 is designed to be brought into contact with the roller 75 or to be moved away therefrom by means of an unillustrated electromagnetic clutch. As moved to the roller 75, the cleaner 76 presses its blade against a surface of the intermediate transfer belt 71 entrained about the roller 75 thereby removing the toner remaining on an outside surface of the intermediate transfer belt 71 after the secondary transfer. The vertical synchronous sensor 77 is a sensor for detecting a reference position of the intermediate transfer belt 71, thus functioning as a vertical synchronous sensor for providing a synchronous signal, or a vertical synchronous signal Vsync outputted in association with the rotating drive of the intermediate transfer belt 71. In the apparatus, operations of the individual parts thereof are controlled based on the vertical synchronous signal Vsync in order to establish synchronism of the operation timings of the individual parts as well as to superimpose the toner images of the different colors precisely on top of each other. These operations are known in the art and the details thereof are described in the aforesaid Japanese Patent Application Laid Open Gazette No.2001-290331, for example. Therefore, the explanation of these operations is omitted herein.

A pre-fixing sensor 78 such as of a photo-interrupter is disposed on the transport path F between the secondary transfer region TR2 and the fixing unit 9. The sensor is used for detection of occurrence of a jammed sheet S on the transport path F. That is, when an image forming operation is performed on the sheet S, whether the sheet S is normally transported or is jammed at any point of the transport path F can be determined based on whether the sheet S passes by the pre-fixing sensor 78 in a predetermined timing or not.

Referring to FIG. 2, a reference numeral 113 represents an image memory provided in the main controller 11 for storing an image supplied from the external apparatus such as a host computer via the interface 112. A reference numeral 106 represents a ROM for storing an operation program to be executed by the CPU 101 and control data used for controlling the engine EG. A reference numeral 107 represents a RAM for temporarily storing operation results given by the CPU 101 and other data.

Figure 3A:
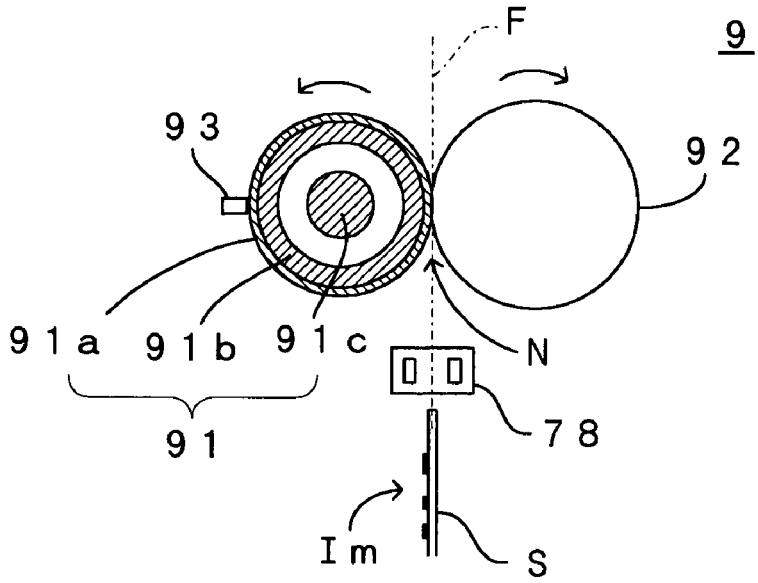
FIG. 3A is an enlarged sectional view showing a structure of the fixing unit 9 of the image forming apparatus.
Figure 3B:
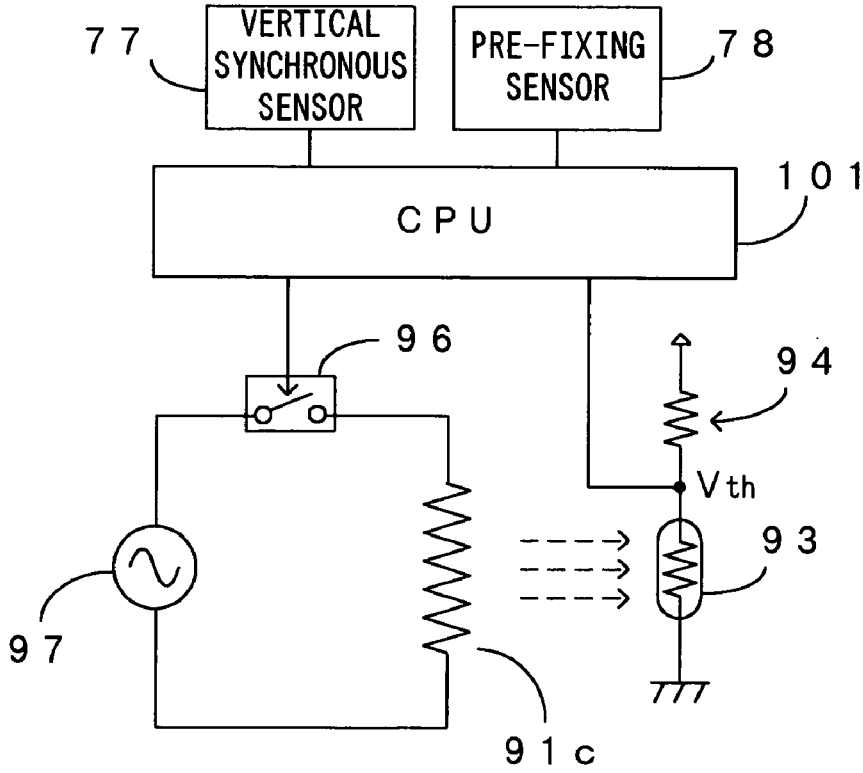
FIG. 3B is a diagram showing a control circuit for the fixing unit.

FIG. 3A is an enlarged sectional view showing a structure of the fixing unit 9 of the image forming apparatus, whereas FIG. 3B is a diagram showing a control circuit for the fixing unit. In the fixing unit 9, a heating roller 91 and a pressurizing roller 92 are disposed in a manner to abut against each other at a nip N. The heating roller 91 includes a sleeve 91*b* formed in a cylindrical shape, and a heater 91*c* inserted in the sleeve 91*b*. The sleeve 91*b* may preferably be formed from a metal having a high thermal conductivity, such as iron, copper, aluminum and alloys thereof. As the heater 91*c*, there may be used a halogen lamp, for example.

A surface layer 91*a* is overlaid on a surface of the sleeve 91*b* such as to permit the toner to be uniformly heated thereby to obviate the occurrence of non-uniform fixing as well as to prevent the toner from being fused to the heating roller 91. While the surface layer 91*a* is formed from a material having heat resistance and elasticity, it is more preferred to use a material having high thermal conductivity. As such a material, there may be used resin materials such as silicone rubber and fluorine compound resins. In addition, a thermistor 93 as "temperature sensing means" for sensing the surface temperature of the heating roller 91 is abutted against the surface layer 91*a* of the heating roller 91. Similarly to the heating roller 91, the pressurizing roller 92 may be a roller including a metal tube or rod having a surface layer such as of a silicone rubber overlaid thereover. From the standpoint of attaining a greater nip width, the surface layer may preferably have a greater thickness than the surface layer of the heating roller 91. When the fixing operation to be described hereinlater is performed, these rollers 91, 92 rotate in respective directions indicated by individual arrows thereabove as seen in FIG. 3A, while the heating roller 91 is so controlled as to be maintained at a predetermined temperature.

The fixing unit 9 of this arrangement controls the surface temperature of the heating roller 91 as follows. Electric resistance of the thermistor 93 abutted against the heating roller 91 varies according to the surface temperature of the heating roller 91. The thermistor 93 is applied with a DC source voltage via a pull-up resistor 94 and hence, a terminal voltage Vth thereof is also varied according to the temperature. Therefore, the CPU 101 can determine the surface temperature of the heating roller 91 from the terminal voltage Vth of the thermistor 93. Based on the actual temperature of the heating roller 91 thus determined and a target temperature thereof, the CPU 101 provides an on/off control for switching on/off the heater 91*c* thereby controlling the surface temperature of the heating roller 91 to the predetermined level. More specifically, a relay 96 is interposed between the heater 91*c* and an AC power source 97 for supplying an electric power to the heater 91*c*, whereas the CPU 101 controls the relay 96 thereby to switch on/off the heater 91*c*. Thus, the surface temperature of the heating roller is raised or lowered. According to the embodiment, the CPU 101 functions as "control means".

As to the energization control method, the CPU 101 may use any of the various conventional control methods heretofore known as the temperature control method. It is preferred, for example, to adopt a PD control during warm-up time when the heating roller 91 at normal temperature need be quickly raised to the predetermined temperature and to adopt a PI control during the fixing operation in which the temperature of the heating roller need be maintained in a predetermined temperature range. As the AC power source 97, the utility power source may be used as it is or otherwise, as electrically isolated and changed in voltage by a transformer.

An image fixing operation by the fixing unit 9 is described with reference to FIG. 3A. A toner image Im carried on the intermediate transfer belt 71 is transferred to a sheet S delivered from the cassette 8 to the secondary transfer region TR2 (FIG. 1). At this time, the toner image Im is simply made to adhere to the sheet S by an electrostatic force and hence, is readily rubbed off. The sheet S is transported to the nip N from below. While the sheet S is passed through the nip N, the toner constituting the toner image Im is molten by the heat from the heating roller 91 and is also pressurized so that the toner is fused to the sheet S. In this manner, the toner image Im is fixed onto the sheet S. According to the embodiment, the heating roller 91 functions as "heating means" of the invention, whereas the nip N is equivalent to "heating position" of the invention.

What is required for achieving the good fixing performance is to subject the sheet S passed through the nip N to a sufficient amount of heat for melting the toner and to a certain pressure. In this respect, the temperature of the heating roller 91 need not be strictly maintained at a constant level at all times but may be maintained in a given temperature range at least during a time period that the sheet S passes through the nip N. The temperature of the heating roller fluctuates particularly greatly when the sheet S passes through the nip N. An arrival timing of the sheet S at the nip N can be grasped from how the operations of the individual portions of the apparatus proceed. Accordingly, it is possible to maintain the temperature of the heating roller 91 at a proper level if the heater 91*c* is supplied with the electric power in an amount counting in the temperature fluctuation associated with the passage of the sheet.

Now, description is made on a temperature control technique for the fixing unit of the image forming apparatus of the above arrangement.

<First Embodiment>

As a method for properly controlling the temperature of the heating roller 91, it may be contemplated to make adjustment per given control time period of say one to several seconds for adjusting an energization time of the heater 91*c* in the control time period. It is noted, however, that there is a time lag before the rise of the surface temperature of the heating roller 91 in response to the supplied electric power. Therefore, the electric power need be supplied in advance of the arrival timing of the sheet S at the nip N. The amount of time lag depends upon the amount of heat generated by the heater 91*c* or the heat capacity of the heating roller 91, thus varying from apparatus from apparatus. Hence, the aforesaid length of control time period should also be properly re-defined according to the characteristics of the apparatus. In addition, consideration need be given to a time difference between the start of energization of the heater 91*c* and the arrival of the sheet S at the nip N.

Figure 4A:
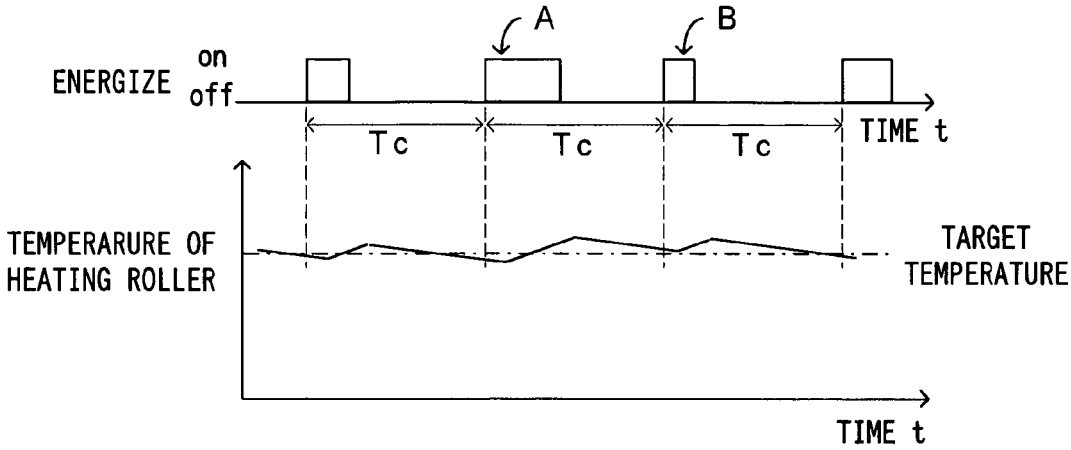
FIGS. 4A, 4B and 4C are charts each representing a relation between the timing of energizing the heating roller and the temperature fluctuations.
Figure 4B:
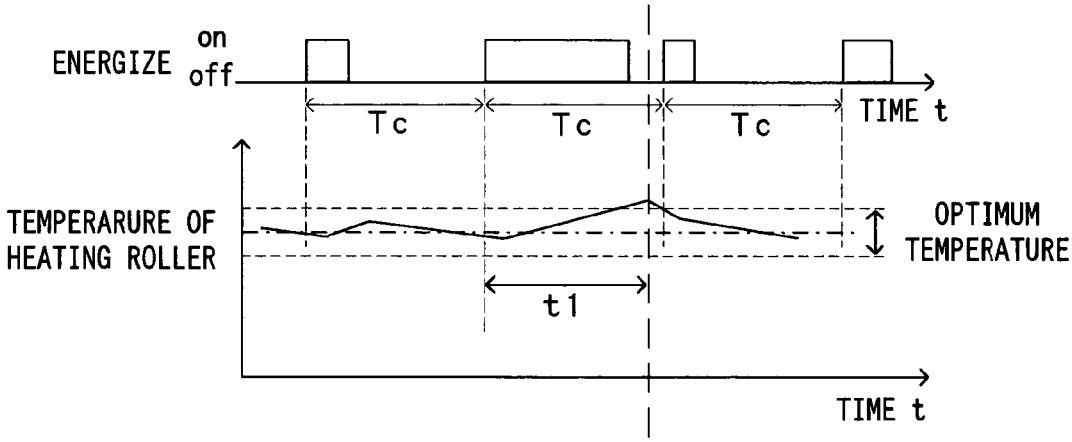
Figure 4C:
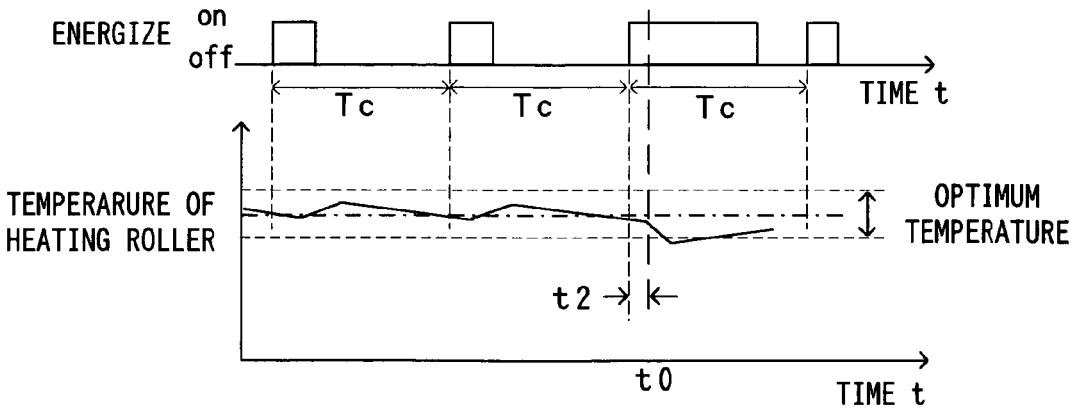

FIGS. 4A, 4B and 4C are charts each representing a relation between the timing of energizing the heating roller and the temperature fluctuations. In a state where the sheet S is not present in the nip N, it is relatively easy to maintain the temperature of the roller 91*b* at a constant level because the heater 91*c* substantially presents a constant heat load. As shown in FIG. 4A, therefore, the surface temperature of the heating roller 91 is sensed per control period Tc of a given length and compared with the target temperature. Then, the time period of energizing the heater 91*c* is adjusted based on the comparison result whereby the temperature of the heating roller 91 can be maintained in the predetermined range. More specifically, where the surface temperature of the heating roller 91 sensed by the thermistor 93 is lower than the target temperature, the energization time is increased (reference character A). Conversely where the sensed surface temperature is higher than the target temperature, the energization time is decreased (reference character B) or the energization of the heater is dispensed with during the time period in question.

When the sheet S arrives at the nip N, however, the temperature of the heating roller 91 abruptly drops. This may effectively be prevented by increasing the power supply to the heater 91*c* just before the sheet S arrives at the nip N. It is noted, however, that if, at this time, the timing between the start of energization of the heater 91*c* and the actual arrival of the sheet S at the nip N is inconsistent, the temperature of the heating roller 91 does not always fluctuate as estimated. In a case where there is a relatively long time period t0 between the start of energization and a time point t0 at which the sheet S arrives at the nip N, as shown in FIG. 4B for instance, the temperature of the heating roller 91 is raised too high. Conversely where there is a short time period t2 between the start of energization and the arrival of the sheet S at the nip N as shown in FIG. 4C, the temperature rise is too late. As a consequence, the temperature of the heating roller 91 is so low as to deviate from the proper temperature range for achieving the good fixing performance.

Hence, the embodiment provides a given correlation between the timing of delivering the sheet S to the nip N and the timing of energizing the heater 91*c* so as to ensure that the heating roller 91 positively has the surface temperature in the predetermined range when the sheet S passes through the nip N. The method of controlling the temperature of the heating roller 91 by managing the energization timing in this manner will be described in more details with reference to FIG. 5.

Figure 5:
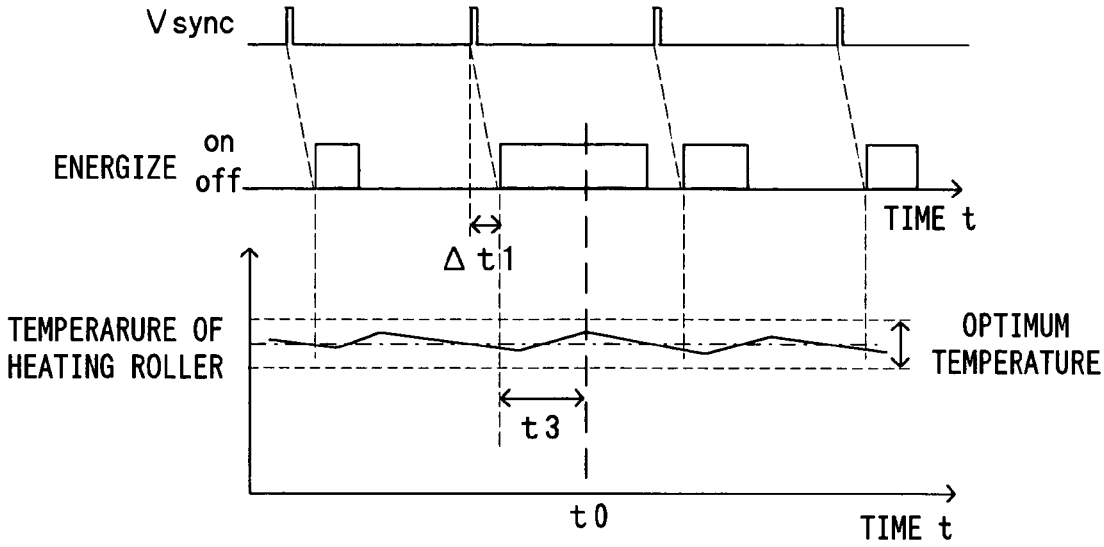
FIG. 5 is a chart showing the energizing timing according to the first embodiment.

FIG. 5 is a chart showing the energizing timing according to the embodiment. The embodiment is arranged to control the energization of the heater 91*c* on the basis of the vertical synchronous signal Vsync outputted from the vertical synchronous sensor 77 in association with a cycling motion of the intermediate transfer belt 71 which is driven into rotation at a given speed while the image forming operation is carried out. That is, the embodiment matches the control time period for temperature control with the repeating period of the vertical synchronous signal Vsync. Thus, according to the embodiment, the vertical synchronous signal Vsync is equivalent to a "timing signal" as a "repetition signal" of the invention. More specifically, a start timing of energization of the heater 91*c* is so defined as to provide a constant time difference Δt1 between a leading edge of the vertical synchronous signal Vsync and the start timing of energization of the heater 91*c*, as shown in FIG. 5.

The following working effects may be obtained by providing the control in this manner. In order to transfer the image onto the sheet S precisely at a predetermined position, the delivery of the sheet S is performed in synchronism with the vertical synchronous signal Vsync. Therefore, a constant time difference is maintained between the shift of the vertical synchronous signal Vsync and the timing of delivering the sheet S to the nip N. Since the constant time difference Δt1 is maintained between the leading edge of the vertical synchronous signal Vsync and the start timing of energization of the heater 91*c*, as mentioned supra, a time difference t3 between the time point t0 for a leading end of the sheet S to reach the nip N and a time point to start the energization of the heater 91*c* just before the arrival of the sheet is also constant.

The temperature of the heating roller 91 is decided by interaction between the temperature rise caused by the energization of the heater 91*c* and the temperature drop due to the passage of the sheet S. If the time difference between the start of energization of the heater 91*c* and the actual arrival of the sheet S at the nip N is consistent as described above, the temperature fluctuation of the heating roller 91 as the result of the aforesaid interaction can be unerringly estimated. By deciding the energization duration of the heater 91*c* based on the estimation, the temperature of the heating roller 91 can be controlled in a stable manner.

As an operation mode for performing the image formation operation, the image forming apparatus has a plain paper mode to form the image on a plain paper sheet and a cardboard mode to form the image on a sheet of cardboard having a greater thickness. The cardboard mode gives consideration to that the sheet S (cardboard) as the recording medium has a greater heat capacity than the plain paper. In the cardboard mode, the sheet S is transported at a lower speed than in the plain paper mode so that the sheet may take a longer time to pass through the nip N thereby allowing the toner to be fully fused to the sheet. However, the target temperature in this mode is set somewhat lower than in the plain paper mode in order to prevent the sheet S from being damaged by heating. More specifically, the target temperatures for the plain paper mode and the cardboard mode are set at 194° C. and at 190° C., respectively.

Figure 6:
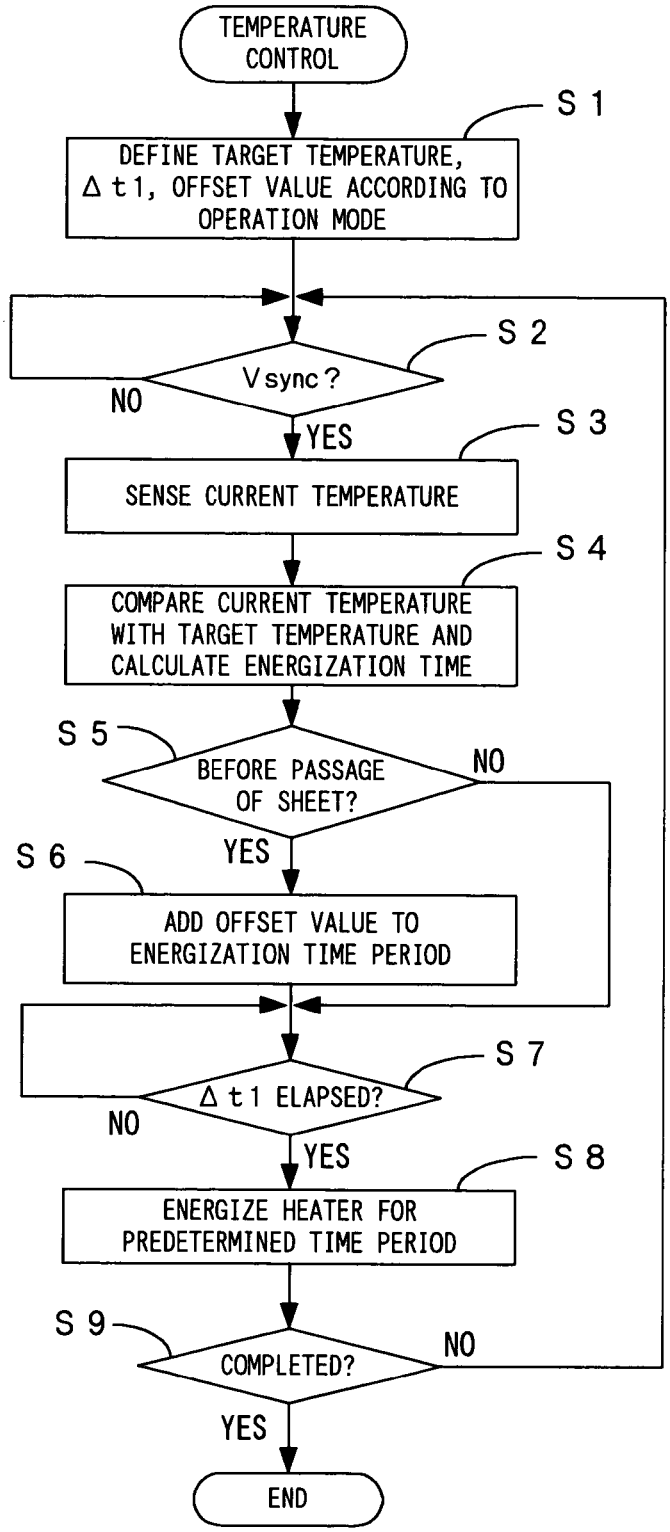
FIG. 6 is a flow chart representing the steps of an operation for controlling the temperature of the heating roller.

FIG. 6 is a flow chart representing the steps of an operation for controlling the temperature of the heating roller. In the image forming apparatus, the CPU 101 executes a temperature control operation shown in FIG. 6 during the performance of the image forming operation, thereby controlling the temperature of the heating roller 91. According to the temperature control operation, determination is first made as to which of the plain paper mode and the cardboard mode is to be performed and then, the target temperature the time difference Δt1 and an offset value are defined according to the operation mode (Step S1). The target temperature is a control target temperature for the heating roller 91. The time difference Δt1 is that shown in FIG. 5, which corresponds to the time period between the leading edge of the vertical synchronous signal Vsync and the start of energization of the heater 91*c*. The offset value is defined for the purpose of compensating for the temperature drop of the heating roller 91 due to the passage of the sheet S through the nip N. The details of the offset value will be described hereinlater.

Then, the control flow waits for a leading edge of the vertical synchronous signal Vsync to come up (Step S2). When the leading edge of the vertical synchronous signal Vsync is detected, a current surface temperature of the heating roller 91 is determined from a terminal voltage value Vth of the thermistor 93 (Step S3). Based on the temperature thus determined and the previously defined target temperature, an energization duration of the heater 91*c* is calculated (Step S4). The energization duration may be calculated based on the principle of the heretofore known temperature control technique such as the PD control or the PID control.

The CPU 101 controls the individual portions of the engine EG based on the vertical synchronous signal Vsync. Therefore, the CPU can estimate a point of time that the sheet S arrives at the nip N. The CPU 101 determines whether or not the sheet S will arrive at the nip N in the subsequent control time period (Step S5). If YES, the previously determined offset value is added to the energization time period thus calculated (Step S6).

By doing so, the energization time period of the heater 91*c* is extended by the amount corresponding to the offset value in the control time period in question. Thus, just before the arrival of the sheet S at the nip N, the heater 91*c* is supplied with a required amount of electric power to maintain the temperature of the heating roller 91 at a constant level plus the additional given amount of electric power.

The foresaid offset value is defined such that the added amount of electric power is equivalent to an amount of heat that the sheet absorbs from the heating roller 91. According to the embodiment, a required and sufficient amount of electric power to compensate for the amount of heat absorbed by the sheet S from the heating roller 91 is supplied to the heater 91*c* prior to the arrival of the sheet S at the nip N. Accordingly, the temperature fluctuation during the passage of the sheet S through the nip N is decreased and as a consequence, the good fixing performance can be achieved. Where, on the other hand, the sheet S is not delivered during the control time period in question (i.e., in case of NO in Step S5), the aforesaid offset value is not added.

Then, after the lapse of the given time period Δt1 from the leading edge of the vertical synchronous signal Vsync (Step S7), the relay 96 (FIG. 3B) is turn on for the energization time period calculated as described above (Step S8). Thus, the required amount of electric power for stabilizing the temperature of the heating roller 91 is supplied to the heater 91*c*. When the fixing operation is terminated, the control operation comes to an end. Otherwise, the control flow returns to Step S2 to repeat the aforementioned operations (Step S9).

As described above, the embodiment performs the temperature control of the heating roller 91 based on the vertical synchronous signal Vsync which is periodically outputted in association with the cycling motion of the intermediate transfer belt 71. Just before the arrival of the sheet S at the nip N, the heater 91*c* is supplied with the amount of electric power that counts in the amount of heat absorbed by the sheet S. This obviates the temperature drop of the heating roller 91. Furthermore, since a time period t3 between the start of energization of the heater 91*c* and the actual arrival of the sheet S at the nip N is constant, the temperature fluctuation of the heating roller 91 can be unerringly estimated so that the required and sufficient amount of electric power may be supplied to the heater 91*c*. Therefore, the temperature of the heating roller 91 can be maintained at the constant level.

The temperature control of the heating roller 91 performed in this manner permits the use of a heating roller 91 having a small heat capacity. Thus, the demand for the reduced warm-up time and power consumption can be satisfied.

When the image forming apparatus does not carry out the image forming operation, the intermediate transfer belt 71 is at rest. During this time period, the vertical synchronous sensor 77 does not output the vertical synchronous signal Vsync. In this case, a similar temperature control technique to that of the prior art may be applied wherein the energization of the heater 91*c* is controlled based on a constant control period, as shown in FIG. 4A. The reason is that a major factor of temperature fluctuation, which is the passage of the sheet S, does not exist and that there is no need for exactly managing the temperature of the heating roller 91 since the fixing operation is not practically carried out. Such a control based on the constant period may be carried out based on a signal obtained by properly dividing the frequency of an operation clock of the CPU 101 or on any other periodic signal.

Such a control operation or the temperature control operation when the image forming operation is not performed may be carried out similarly in the other embodiments to be described hereinlater.

The practical image forming operation is performed as follows. When a demand for forming an image is received from an external apparatus, the toner image is first formed on the intermediate transfer belt 71. The toner image is transferred to the sheet S and then fixed thereto. Accordingly, the vertical synchronous signal Vsync is thought to be outputted at least plural times before the sheet S arrives at the nip N. It is therefore preferred to perform the temperature control of the heating roller 91 based on the constant control period Tc when the apparatus is on standby, and to perform the temperature control based on the vertical synchronous signal Vsync when the signal Vsync is detected. This approach can assuredly maintain the temperature of the heating roller 91 in the predetermined range at least during the passage of the sheet S through the nip N.

The amount of heat absorbed by the sheet S varies depending upon not only the thickness of the sheet S but also the size thereof. It is therefore desirable that the aforesaid offset value is defined for each size of the sheet S to be used.

There may be contemplated an alternative method to provide the control for maintaining the heating roller 91 at the predetermined temperature, the method wherein the surface temperature of the heating roller 91 is sensed in a shorter control period and the energization of the heater 91*c* is finely controlled based on the comparison between the sensing result and the target temperature. The method may be performed, for example, by controlling the energization of the heater 91*c* by way of an inverter, controlling the firing angle of the AC voltage by means of a thyristor, or the like. However, the implementation of such a control requires an apparatus of more complicated arrangement. As mentioned supra, what is required of such a fixing unit 9 is to maintain the temperature of the heating roller 91 in the predetermined range at least during the passage of the sheet S through the nip N. The application of such a complicated control to satisfy this requirement only results in an increased apparatus cost but does not offer much practical merit.

In contrast, the temperature control performed in the apparatus of the embodiment can be realized at low costs, requiring no special arrangement. This is because the embodiment adopts a relatively simple on/off control of the energization of the heater 91*c* based on a relatively long control period. (e.g., one to several seconds), the control only requiring to manage the energization timing to match it with the sheet delivery timing.

These working effects of the invention may be similarly achieved by the following embodiments.

<Second Embodiment>

Figure 7A:
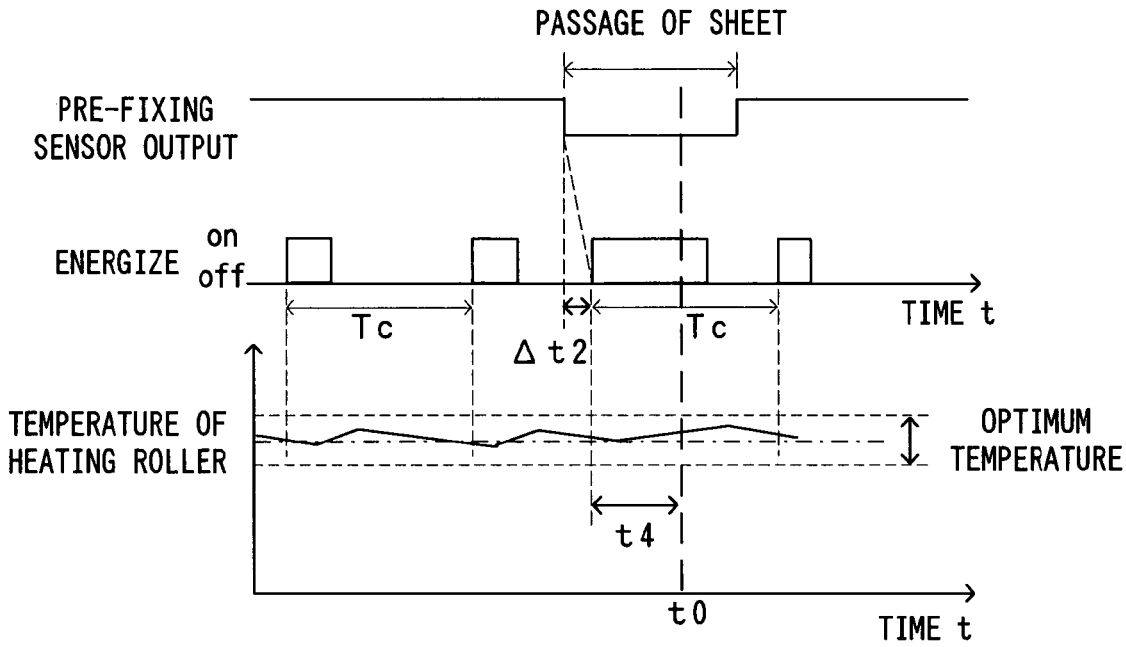
FIGS. 7A and 7B are charts representing the energization timing according to the second embodiment.
Figure 7B:
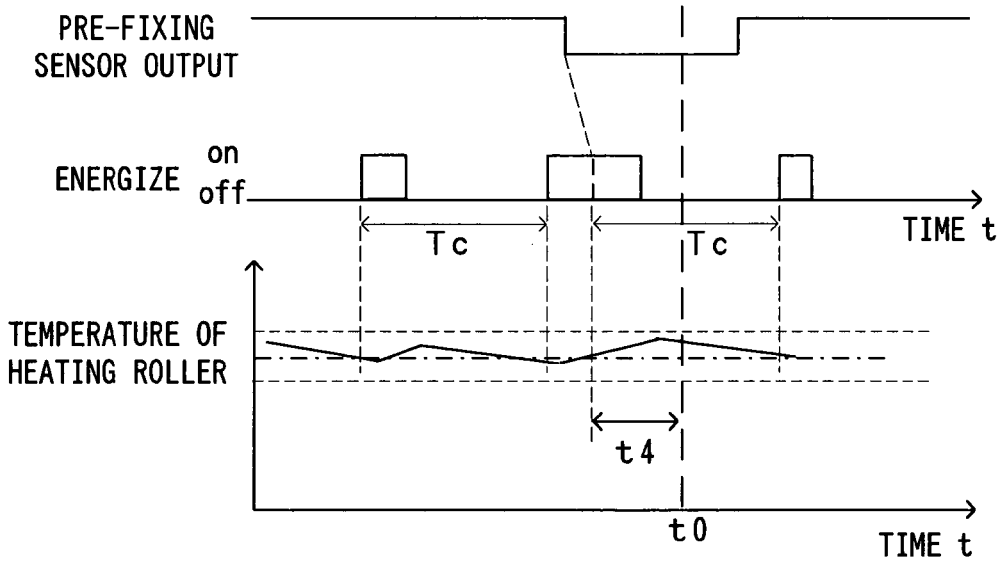

FIGS. 7A and 7B are charts each representing a relation between the timing of energizing the heating roller and the temperature fluctuations in the image forming apparatus according to the second embodiment of the invention. In this embodiment, as well, the arrangement of the apparatus and the basic operations thereof are the same as those of the apparatus of the first embodiment described above. However, a part of the operation for controlling the temperature of the heating roller 91 is different. So referring to FIGS. 3A, 3B, 7A and 7B, a temperature control operation according to the second embodiment will be described by way of comparison with the aforementioned temperature control operation of the first embodiment.

The apparatus of the first embodiment controls the temperature of the heating roller 91 based on the vertical synchronous signal Vsync outputted in association with the cycling motion of the intermediate transfer belt 71. In contrast, the second embodiment controls the temperature of the heating roller 91 based on an output signal from the prefixing sensor 78. As shown in FIG. 3A, the prefixing sensor 78 is a photo-interrupter disposed in the sheet transport path F at place upstream from the fixing unit 9. While the sheet S transported from below as seen in FIG. 3A passes by the pre-fixing sensor 78, transmission/reception of light between a light emitter and a light receiver of the sensor is interrupted so that the output signal from the sensor is shifted from H- to L-level. Thus, the passage of the sheet S can be detected.

The sheet S passed by the pre-fixing sensor 78 is subsequently passed through the nip N of the fixing unit 9. Therefore, the output signal from the pre-fixing sensor 78 can serve as a timing signal indicative of the arrival timing of the sheet S at the nip N. That is, the sheet S should reach the nip N after a lapse of a predetermined time period from its arrival at the pre-fixing sensor 78, the predetermined time period determined from a transportation speed of the sheet and a distance between the pre-fixing sensor 78 and the nip N.

Hence, the embodiment defines the start timing of energization of the heater 91*c* such that, as shown in FIG. 7A, when the shift of the output signal from the pre-fixing sensor 78 is detected, a constant time period Δt2 is provided between the detection of the signal shift and the start of energization of the heater 91*c*. Similarly to the apparatus of the first embodiment, this arrangement ensures that a time difference t4 between the start of energization of the heater 91*c* and the actual arrival of the sheet S at the nip N is constant. Hence, the temperature of the heating roller 91 during the passage of the sheet S through the nip N can be maintained in the predetermined range. As a result, the heating roller 91 is maintained at the optimum temperature during the fixing operation and the good fixing performance can be achieved.

Where the output signal from the pre-fixing sensor 78 is retained at H-level, the temperature control may be carried out based on the constant control period Tc just as in the first embodiment. In a case where the output from the pre-fixing sensor 78 is shifted to L-level during the energization of the heater 91*c*, as shown in FIG. 7B, the energization time may be re-calculated at this point of time and settings may be made such that an alternative control time period is started a time t4 earlier than the time t0 for the sheet S to arrive at the nip N.

<Third Embodiment>

Figure 8:
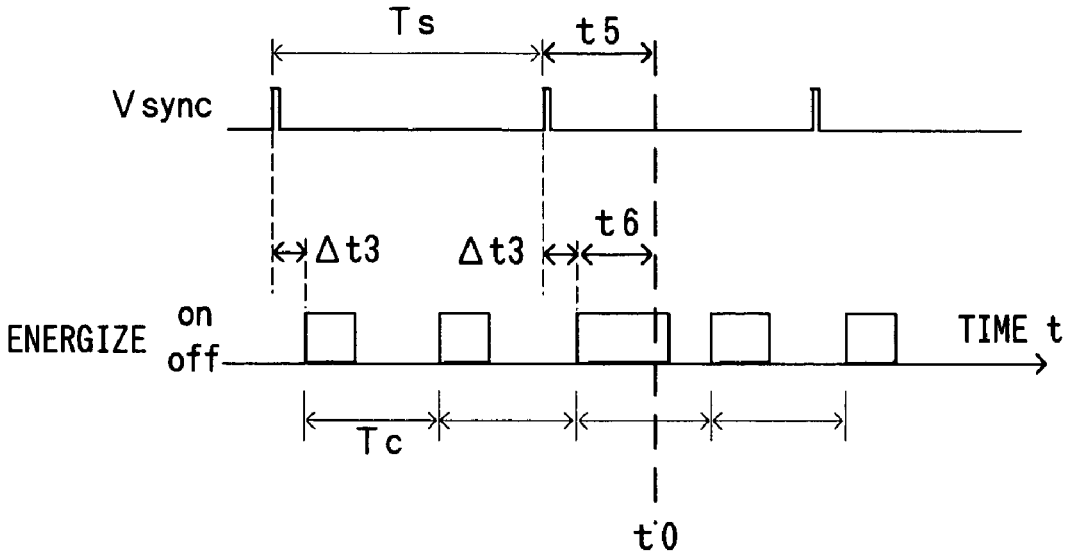
FIG. 8 is a chart representing the energization timing according to the third embodiment.

FIG. 8 is a chart showing the energization timing according to the embodiment. The embodiment is arranged to control the energization of the heater 91*c* on the basis of the vertical synchronous signal Vsync outputted from the vertical synchronous sensor 77 in association with the cycling motion of the intermediate transfer belt 71 which is driven into rotation at a given speed while the image forming operation is carried out. That is, the embodiment defines the control period Tc for temperature control as ½ of a repetition period Ts of the vertical synchronous signal Vsync or Tc=Ts/2. Assumed that the intermediate transfer belt 71 takes 3 seconds to make one cycle motion, for example, the control period is 1.5 seconds. It is noted, however, that the shift of the vertical synchronous signal Vsync need not necessarily coincide with the start time of energization of the heater 91*c*. As shown in FIG. 8, there may be a given time difference Δt3 between the signal shift and the start of energization.

The following working effects may be obtained by providing the control in this manner. In order to transfer the image onto the sheet S precisely at the predetermined position, the delivery of the sheet S is performed in synchronism with the vertical synchronous signal Vsync. That is, a time difference t5 between the shift of the vertical synchronous signal Vsync and the time t0 for the sheet S to arrive at the nip N is constant. As described above, the energization of the heater 91*c* is started after a lapse of the given time period Δt3 from the shift of the vertical synchronous signal Vsync. Therefore, a time difference t6 (=t5−Δt3) between the start time of energization and the time t0 for the sheet S to arrive at the nip N is also constant.

The temperature of the heating roller 91 is decided by the interaction between the temperature rise caused by the energization of the heater 91*c* and the temperature drop due to the passage of the sheet S. If the time period between the start of energization of the heater 91*c* and the actual arrival of the sheet S at the nip N is consistent as described above, the temperature fluctuation of the heating roller 91 as the result of the aforesaid interaction can be unerringly estimated. By deciding the duration period of energizing the heater 91*c* based on the estimation, the temperature of the heating roller 91 can be controlled in a stable manner.

The image forming apparatus also has the two operation modes including the plain paper mode and the cardboard mode. Since the transport speed of the sheet S is varied between these operation modes, the time difference Δt3 between the shift of the vertical synchronous signal Vsync and the start of energization of the heater 91*c* also need be varied from one operation mode to the other.

Figure 9:
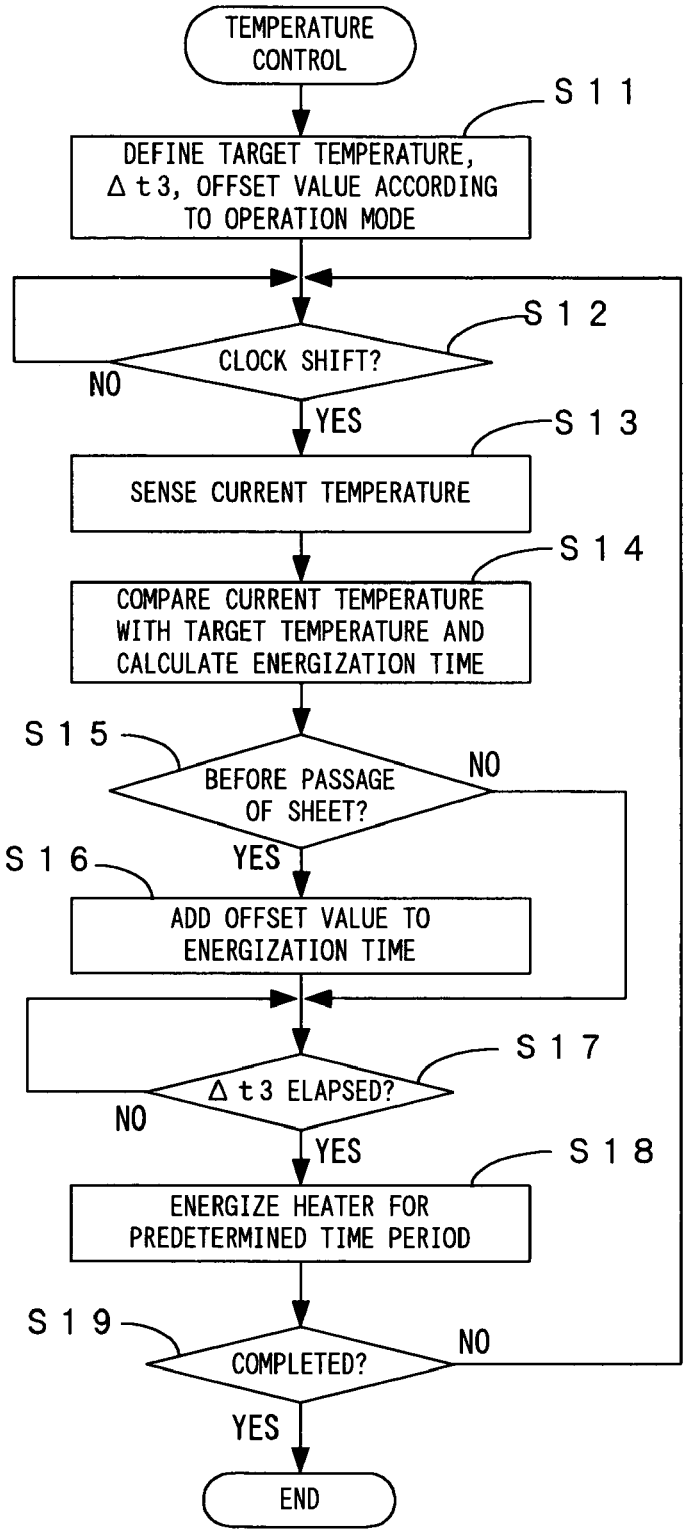
FIG. 9 is a flow chart representing the steps of a temperature control operation for the heating roller according to the embodiment.

FIG. 9 is a flow chart representing the steps of a temperature control operation for the heating roller according to the embodiment. The temperature control operation (Steps S11–S19) is performed the same way as in the first embodiment shown in FIG. 6, except that the operation is performed based on a control clock obtained by doubling the frequency of the vertical synchronous signal Vsync (Step S12) instead of the vertical synchronous signal.

<Fourth Embodiment>

Figure 10:
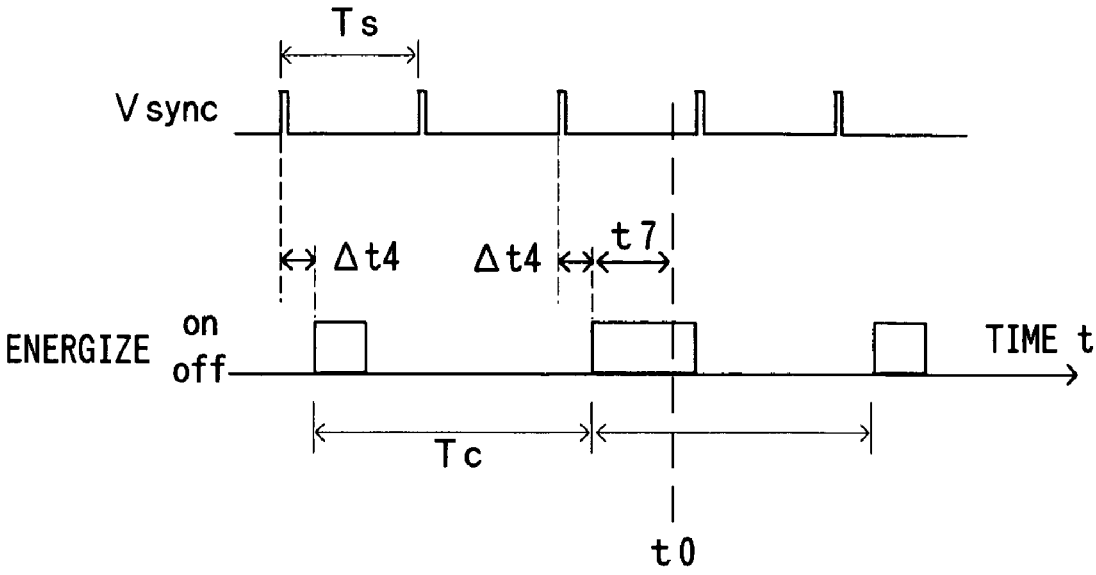
FIG. 10 is a chart representing the energization timing according to the fourth embodiment.

FIG. 10 is a chart showing a relation between the timing of energizing the heating roller and the temperature fluctuations in an image forming apparatus according to a fourth embodiment of the invention. In the apparatus of the third embodiment, the temperature control of the heating roller 91 is performed based on the control clock obtained by multiplying the frequency of the vertical synchronous signal Vsync outputted in association with the cycling motion of the intermediate transfer belt 71. In contrast, the fourth embodiment controls the temperature of the heating roller 91 based on a control clock obtained by dividing the frequency of the vertical synchronous signal Vsync to a half. That is, Tc=2Ts according to this embodiment. Except for this, the operations are the same as those of the apparatus of the third embodiment.

According to the temperature control operation thus arranged, as well, the same working effects as those offered by the apparatus of the third embodiment can be attained. That is, the energization of the heater 91*c* is started a given time period t7 earlier than the time t0 when the sheet S arrives at the nip N, whereby the temperature is stably maintained during the passage of the sheet S through the nip N.

Given the same length of period Ts of the vertical synchronous signal Vsync, such a temperature control operation has a longer control time period Tc than that of the operation of the third embodiment. Hence, the control operation is less suited for coping with fine temperature fluctuations. However, the operation reduces the load on the CPU 101 because of a lower frequency of the processings. Accordingly, such a control method is favorable in a case where, for example, the heating roller 91 has a relatively great heat capacity so that the roller is slow to be raised in temperature but is decreased less in temperature due to contact with the sheet S. Furthermore, such an increased control period Tc is effective to make flickers less apparent, which occur in other illumination devices and the like in conjunction with the switch on/off of the heater.

As will be described hereinlater, the control period Tc may be defined based on a periodic signal other than the vertical synchronous signal Vsync. In a case where the periodic signal has a relatively short period (e.g., a drive pulse for a pulse motor), the temperature control may preferably be performed based on a control clock obtained by dividing the frequency of the periodic signal.

In the aforementioned third and fourth embodiments, the respective temperature control periods Tc for the heating roller 91 are defined to be a half and double the period Ts of the vertical synchronous signal Vsync outputted in correspondence to the cycling motion of the intermediate transfer belt 71. That is, these embodiments are equivalent to the case of n=2 according to the invention. However, the ratio between the period Ts of the vertical synchronous signal Vsync and the control period Tc is not limited to this and may take other values. If, in this case, the ratio between these periods is an integer, there is always a constant time difference between the timing of passing the sheet S through the nip N and the start timing of energization of the heater 91*c*. Such an arrangement facilitates the estimation of the temperature fluctuation of the heating roller 91 during the time period between the start of energization of the heater 91*c* and the passage of the sheet S. Thus, the temperature of the heating roller 91 can be stabilized by controlling the energization duration based on the estimation thus made.

The signal usable as the periodic signal for defining the control period Tc is not limited to the vertical synchronous signal Vsync but may be any other signal having some regularity with respect to the transport timing of the sheet S. For instance, the control period Tc for temperature control may be defined based on a periodic signal outputted in association with the rotation of the photosensitive member 2, or a drive pulse or the like applied to a pulse motor (not shown) for driving the intermediate transfer belt 71, the photosensitive member 2 or a sheet feeding roller disposed on the sheet transport path F may be used. As required, the frequency of the periodic signal or the drive pulse may be divided or multiplied.

<Fifth Embodiment>

Next, description is made on a fifth embodiment of the invention which is suited for a case where the repetition period of the vertical synchronous signal Vsync is varied. In such a case, the temperature control method on assumption that the vertical synchronous signal Vsync has the constant period does not naturally hold.

Figure 11A:
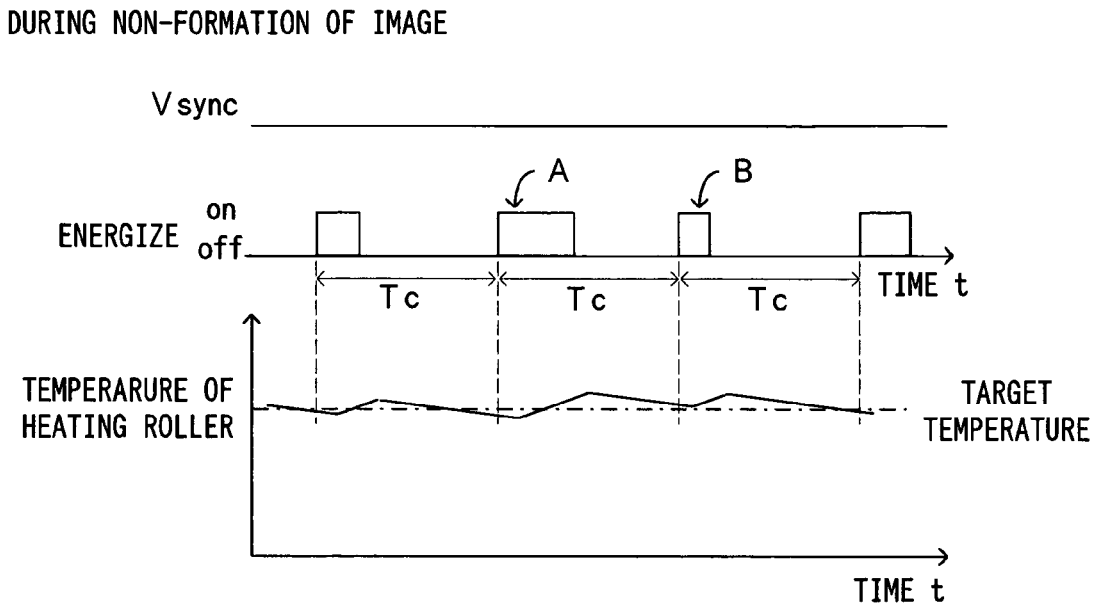
FIGS. 11A and 11B are charts each representing a relation between the timing of energizing the heating roller and the temperature fluctuations on assumption that the control period is constant.
Figure 11B:
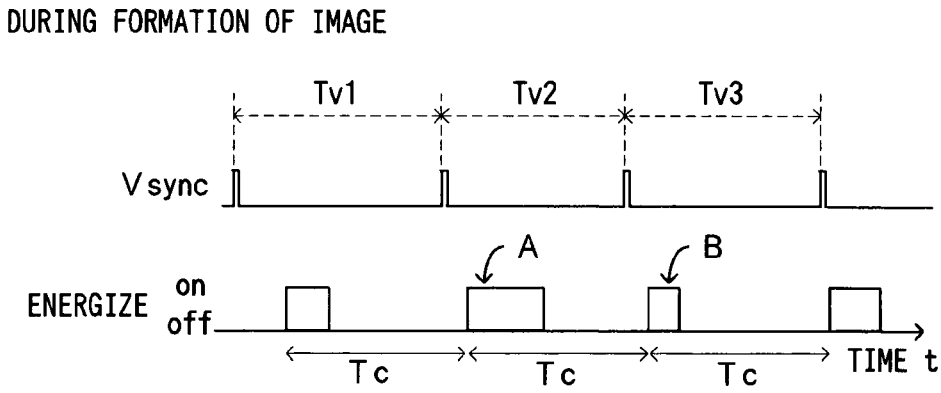

FIGS. 11A and 11B are charts each representing a relation between the timing of energizing the heating roller and the temperature fluctuations on assumption that the control period is constant. In a state where the color image formation is not carried out so that the sheet S is not present in the nip N, it is relatively easy to maintain the temperature at a constant level because the heater 91*c* substantially presents a constant heat load. As shown in FIG. 11A, therefore, the temperature of the heating roller 91 can be maintained in the predetermined range by sensing the surface temperature of the heating roller 91 per constant control period Tc; comparing the sensed temperature with the target temperature; and then, adjusting the energization time of the heater 91*c* based on the comparison result. More specifically where the surface temperature of the heating roller 91 sensed by the thermistor 93 is lower than the target temperature, the energization time is increased (reference character A). Conversely where the sensed surface temperature is higher than the target temperature, the energization time is decreased (reference character B) or the energization is dispensed with during the time period in question.

Hence, while the formation of the color image is not carried out (during the non-formation of image), the temperature of the heater 91*c* (fixing temperature) can be stably controlled by repeating the temperature control operation in the aforementioned manner. When the color image is formed, the vertical synchronous signal Vsync is outputted each time the intermediate transfer belt 71 makes one cycling motion. However, the signals are outputted not always in constant period but in varied periods Tv1, Tv2, Tv3, . . . . The period of the signal varies depending upon the operation conditions. In the image forming apparatus, specifically, a series of operations (image forming/transferring process) including the formation of a toner image, the primary transfer of the toner image to the intermediate transfer belt 71, the cleaning of the intermediate transfer belt and the like are repeated for the respective toner colors. Furthermore, abutment means, such as the blade of the cleaner or the secondary transfer roller, is temporarily abutted against the intermediate transfer belt 71 or disengaged therefrom for secondarily transferring the color toner image on the intermediate transfer belt 71 to the sheet S. Thus, the abutment and disengagement of the abutment means lead to incapability of rotatingly moving the intermediate transfer belt at a constant speed. Accordingly, the periods Tv1, Tv2, Tv3, . . . of the vertical synchronous signal Vsync become inconsistent during the formation of the color image and hence, the temperature control operation and the pre-fixing operation are out of timing relative to each other. As a result, the good fixing performance cannot be achieved.

When the sheet S arrives at the nip N, the temperature of the heating roller 91 abruptly drops. This may effectively be prevented by increasing the power supply to the heater 91*c* just before the arrival of the sheet S at the nip N. If at this time, the timing between the energization of the heater 91*c* and the actual arrival of the sheet S at the nip N is inconsistent, the temperature of the heating roller 91 does not always fluctuate as estimated. This problem has already been described (see, FIGS. 4A, 4B and 4C).

Figure 12:
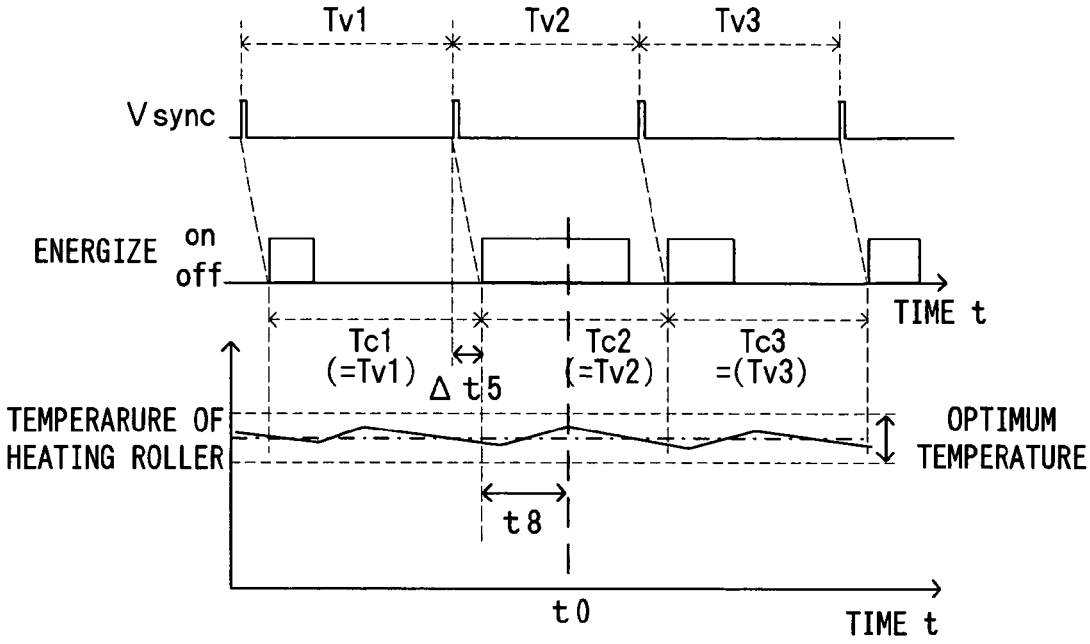
FIG. 12 is a chart representing the energization timing according to the fifth embodiment.

FIG. 12 is a chart representing the energization timing according to the embodiment. In this embodiment, the energization of the heater 91*c* is controlled on the basis of the vertical synchronous signal Vsync outputted from the vertical synchronous sensor 77 in association with the cycling motion of the intermediate transfer belt 71 driven into rotation at a constant speed when the image forming operation is performed. Specifically, the embodiment matches the control time period of the temperature control with the repeating period of the vertical synchronous signal Vsync. As shown in the figure, the embodiment defines the start timing of energization of the heater 91*c* such that a constant time difference Δt5 may be provided between the leading edge of the vertical synchronous signal Vsync and the start timing of energization of the heater 91*c*.

The following working effects may be obtained by providing the control in this manner. Firstly, the vertical synchronous sensor 77 outputs the synchronous signal corresponding to the rotary motion of the intermediate transfer medium or the vertical synchronous signal Vsync, based on which signal Vsync the energization of the heater 91*c* is controlled. Therefore, the periods Tv1, Tv2, Tv3, . . . of the vertical synchronous signal Vsync coincide with the periods Tc1, Tc2, Tc3, . . . of the temperature control operation which correspond to the individual vertical synchronous signals Vsync. According to the embodiment, the pre-fixing operations performed prior to the fixing process are in matched relation with the fixing operation for fixing the color toner image to the sheet S, the pre-fixing operation including the formation of the toner image, the transfer of the color toner image to the sheet S and such. Thus, the embodiment stably controls the fixing temperature so as to achieve the good fixing performance.

In order to transfer the image onto the sheet S precisely at the predetermined position, the delivery of the sheet S is performed in synchronism with the vertical synchronous signal Vsync. Therefore, a constant time difference is maintained between the shift of the vertical synchronous signal Vsync and the arrival timing of the sheet S at the nip N. Since the constant time difference Δt5 is maintained between the leading edge of the vertical synchronous signal Vsync and the start timing of energization of the heater 91*c*, as described above, there is also provided a constant time difference t8 between the time t0 for a leading end of the sheet S to reach the nip N and the time to start the energization of the heater 91*c* just before the arrival of the sheet.

The temperature of the heating roller 91 is decided by the interaction between the temperature rise caused by the energization of the heater 91*c* and the temperature drop due to the passage of the sheet S. If the time period between the start of energization of the heater 91*c* and the actual arrival of the sheet S at the nip N is consistent as described above, the temperature fluctuation of the heating roller 91 as the result of the aforesaid interaction can be unerringly estimated. By deciding the time period of energization of the heater 91*c* based on the estimation, the temperature of the heating roller 91 can be controlled in a stable manner.

It is noted that a flow chart representing the temperature control operation of the embodiment is the same as the flow chart (FIG. 6) of the first embodiment.

As described above, the embodiment accomplishes the temperature control of the heating roller 91 by performing the temperature control operation based on the vertical synchronous signal Vsync periodically outputted in association with the cycling motion of the intermediate transfer belt 71. Therefore, there can be established the coincidence between the periods of the vertical synchronous signal Vsync and the periods of the temperature control operations corresponding to the individual vertical synchronous signals although, in the color image forming apparatus, the speed of the intermediate transfer belt 71 is varied in conjunction with the abutment/disengagement of the blade of the cleaner 6, the secondary transfer roller or the like against/from the intermediate transfer roller. As a consequence, the pre-fixing operation can be matched with the fixing operation. Thus, the stable control of the fixing temperature can be performed thereby to achieve the good fixing performance.

In the temperature control operation corresponding to the timing of delivering the sheet S to the fixing unit 9 (the output timing of the second vertical synchronous signal Vsync in FIG. 12), the amount of electric power counting in the amount of heat absorbed by the sheet S is supplied to the heater 91*c* of the heating roller 91 just before the time t0 for the sheet S to arrive at the nip N. Thus is obviated the temperature drop of the heating roller 91. Furthermore, the constant time period t8 is provided between the start of energization of the heater 91*c* and the actual arrival of the sheet S at the nip N. This permits the temperature fluctuation of the heating roller 91 to be unerringly estimated. Based on the unerring estimation, the required and sufficient amount of electric power may be supplied to the heater 91*c*. As a result, the temperature of the heating roller 91 can be stably maintained.

The above embodiment defines the individual periods Tc1, Tc2, Tc3, . . . (temperature control periods) of the temperature control operation for the beating roller 91 to be one time the respective periods Tv1, Tv2, Tv3, . . . of the vertical synchronous signal Vsync outputted in correspondence to the cycling motion of the intermediate transfer belt 71. Alternatively, the control period (the period of the temperature control operation) to control the energization time period of the heater 91*c* may be defined to be an integral multiple or an integral fraction of the period of the vertical synchronous signal Vsync.

<Modifications>

It is to be understood that the invention is not limited to the foregoing embodiments and various changes and modifications other than the above may be made thereto so long as such changes and modifications do not deviate from the scope of the invention. For instance, the signal usable as the "timing signal" may include, besides the aforementioned vertical synchronous signal Vsync and the output signal from the prefixing sensor 78, any signal that indicates the timing of delivering the sheet S to the fixing unit 9. For example, a control signal applied to the sheet feeding roller (not shown) for delivering the sheet S along the transport path F may be used as the timing signal.

For instance, the heater 91*c* provided at the heating roller 91 is not limited to the halogen lamp and a heating element of a different system may be used. However, it is desirable that the heating element can quickly raise the temperature in response to a control input. The control target temperature is not limited to the aforesaid value but may be properly decided according to the properties of the toner and the recording medium.

In the foregoing embodiments, the temperature of the heating roller 91 is sensed by abutting the thermistor 93 against the heating roller 91 as the heating means. However, the method for sensing the temperature of the heating means is not limited to this. There may be used, for example, temperature sensing means which is adapted for non-contact measurement of the temperature of a subject. Alternatively, the temperature of the heating means may be indirectly sensed via another member the physical properties of which are changed according to the temperature of the heating means.

For instance, the image forming apparatus of the foregoing embodiments has two operation modes including the plain paper mode and the cardboard mode and is arranged such that individual parameters are set in each operation mode, the parameters including the target temperature of the heating roller 91, the time difference Δt and the offset value. However, instead of these operation modes or in addition thereto, there may be provided other plural operation modes to be performed in different fashions, such as a color mode and a monochromatic mode or a standard image mode and a high-quality image mode. A manner to change the individual parameters may be properly defined according to how the apparatus operates in each of the operation modes.

In the color mode and the monochromatic mode, for example, these parameters may be defined the same way. It is noted, however, that in the color mode, the toner images formed in individual colors are sequentially superimposed on top of each other on the intermediate transfer belt 71 thereby to form the full color image, which is then transferred onto the sheet S. Therefore, attention must be paid to that the color mode requires a greater length of time between the start of the image forming operation and the arrival of the sheet S at the nip N as compared with the monochromatic mode.

In the foregoing embodiments, the temperature drop of the heating roller 91 due to the contact with the sheet S is prevented by taking the measure wherein the time t0 for the sheet S to arrive at the nip N is estimated so as to increase the energization time period of the heater 91*c* by the offset value, the energization of the heater started just before the time t0. Alternatively, an amount of electric power counting in an estimated temperature drop of the heating roller 91 may be supplied to the heater at least plural cycles in advance of the time t0 with respect to the temperature control period Tc, the time t0 when the sheet S arrives at the nip N. In addition to referring to the arrival time t0 of the sheet S, time when the sheet S leaves the nip N may be estimated from the size of the sheet S and based on the estimation, the amount of electric power to be supplied to the heating roller 91 may be adjusted.

The details of the operations may be properly defined on a per-apparatus basis in accordance with the amount of heat generated by the heater 91*c*, the heat capacity of the heating roller 91, the heat capacity or allowable temperature range of the sheet S and the like. In this case, the control period for the energization of the heater 91*c* may be defined based on some periodic signal associated with the sheet delivery timing thereby providing a certain correlation between the energization timing and the timing of passing the sheet S through the nip N. Thus is attained the working effect of the invention that the temperature of the heating roller 91 is stabilized.

While the foregoing embodiments pertain to the image forming apparatus capable of forming a full color image using toners of four colors, the invention is not limited to such an apparatus but is also applicable to an image forming apparatus which includes only a developing device corresponding to a black toner and thus is designed to form a monochromatic image (except for the fifth embodiment). Further, the foregoing embodiments pertain to the image forming apparatus serving as a printer for forming an image corresponding to an image signal from a host computer. However, the invention is also applicable to other image forming apparatuses such as copiers and facsimiles.

Furthermore, while the foregoing embodiments employ the intermediate transfer belt 71 as the intermediate transfer medium, the invention is also applicable to an image forming apparatus wherein the color image is formed by transferring the toner images to a transfer medium (such as an intermediate transfer drum or an intermediate transfer sheet) other than the intermediate transfer belt.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus comprising:

image forming means performs image formation for forming a toner image and transferring said toner image on a recording medium;

heating means for heating a toner carried on said recording medium as forming said toner image, thereby fixing said toner image to said recording medium;

sensor which is disposed on a transport path of said recording medium between said image forming means and said heating means for detecting passage of said recording medium, and outputs a timing signal associated with a timing of delivering said recording medium from said image forming means to said heating means; and control means for controlling said heating means to a predetermined temperature by switching on/off the energization of said heating means based on said timing signal, wherein said control means switches on the energization of said heating means a predetermined length of time in advance of a moment that a leading end of said recording medium with respect to a delivery direction of said recording medium arrives at a heating position in which said heating means heats said recording medium.

2. An image forming apparatus of claim 1, wherein said image forming means is capable of selectively performing, as said image formation, any one of plural operation modes to form said toner image in individually different manners, and said predetermined length of time is defined for each of said plural operation modes.

3. An image forming apparatus of claim 1, wherein said control means is capable of re-defining a control target temperature for said heating means, and defines said predetermined length of time according to said control target temperature.

4. An image forming apparatus of claim 1, wherein when the fixing of said toner image to said recording medium is not carried out, said control means makes adjustment per given control time period for adjusting the energization time of said heating means in the control time period.

5. An image forming apparatus of claim 1, further comprising temperature sensing means for sensing the temperature of said heating means, wherein said control means controls the temperature of said heating means based on the sensing result.

6. An image forming apparatus of claim 5, wherein said control means decides the energization time of said heating means based on said timing signal and the sensing result given by said temperature sensing means.

7. A fixing-temperature control method for an image forming apparatus which fixes a toner image onto a recording medium by heating toners by way of heating means, the toners carried on said recording medium as forming said toner image, comprising the steps of:

outputting a timing signal associated with a timing of delivering said recording medium to said heating means; and controlling said heating means to a predetermined temperature by switching on the energization of said heating means a predetermined length of time in advance of a moment that a leading end of said recording medium with respect to a delivery direction of said recording medium arrives at a heating position in which said heating means heats said recording medium based on said timing signal.

8. An image forming apparatus comprising:

image forming means performs an image formation for forming a toner image and transferring said toner image on a recording medium;

heating means for heating a toner carried on said recording medium as forming said toner image, thereby fixing said toner image to said recording medium; and control means for controlling said heating means to a predetermined temperature by adjusting an energization time period of said heating means in a predetermined control period, wherein said control means defines a length of said control period to be N or 1/N (N representing a natural number) times the period of a periodic signal associated with a timing of delivering said recording medium from said image forming means to said heating means.

9. An image forming apparatus of claim 8, wherein said image forming means further comprises an intermediate transfer medium rotatingly movable in a predetermined direction, and transfers said toner image carried on said intermediate transfer medium, and wherein a period of said periodic signal is associated with a rotational period of said intermediate transfer medium.

10. A fixing-temperature control method for an image forming apparatus which fixes a toner image onto a recording medium by heating toners by way of heating means, the toners carried on said recording medium as forming said toner image, comprising the steps of:

outputting a periodic signal associated with a timing of delivering said recording medium to said heating means; and controlling said heating means to a predetermined temperature by adjusting an energization time of said heating means within a control period which is defined to be N or 1/N (N representing a natural number) times the period of said periodic signal.

11. An image forming apparatus comprising:

image forming means which has an intermediate transfer medium rotatingly movable in a predetermined direction and which performs an image formation for forming a plurality of toner images of different colors and forming a color image by superimposing said toner images on top of each other on said intermediate transfer medium;

signal generating means for outputting a synchronous signal corresponding to a rotating motion of said intermediate transfer medium;

heating means for heating toners carried on said recording medium as forming said color toner image, thereby fixing said color toner image to said recording medium; and control means for controlling said heating means to a predetermined temperature by switching on/off the energization of said heating means, wherein said control means controls the energization of said heating means based on said synchronous signal.

12. An image forming apparatus of claim 11, wherein said control means controls said heating means to the predetermined temperature by repeating a temperature control operation of adjusting an energization time of said heating means in one cycle and besides, changes the period of the temperature control operation according to an output period of said synchronous signal.

13. An image forming apparatus of claim 11, wherein said control means controls a delivery timing of said recording medium based on said synchronous signal, the recording medium delivered from said transferring means to said heating means.

14. An image forming apparatus of claim 11, wherein said control means switches on the energization of said heating means a predetermined length of time in advance of a moment that a leading end of said recording medium with respect to a delivery direction of said recording medium arrives at a heating position in which said heating means heats said recording medium.

15. An image forming apparatus of claim 14 in which said image forming means is capable of selectively performing, as said image formation, any one of plural operation modes to form said toner image in individually different manners, wherein said predetermined length of time is defined for each of said plural operation modes.

16. An image forming apparatus of claim 14, wherein said control means is capable of re-defining a control target temperature for said heating means and besides, defines said predetermined length of time according to said control target temperature.

17. An image forming apparatus of claim 11, wherein when the formation of the color toner image is not carried out, said control means makes adjustment per given control time period for adjusting the energization time of said heating means in the control time period.

18. An image forming apparatus of claim 11, further comprising temperature sensing means for sensing the temperature of said heating means, wherein said control means controls the temperature of said heating means based on the sensing result.

19. An image forming apparatus of claim 18, wherein said control means decides the energization time of said heating means based on said synchronous signal and the sensing result given by said temperature sensing means.

20. A fixing-temperature control method for an image forming apparatus which transfers a color toner image to a recording medium, the color toner image formed by superimposing toner images of multiple different colors on top of each other on an intermediate transfer medium rotatingly movable in a predetermined direction and which fixes said color toner image onto said recording medium by heating toners by way of heating means, the toners carried on the recording medium as forming the color toner image, comprising the steps of:

outputting a synchronous signal associated with the rotating motion of said intermediate transfer medium; and controlling said heating means to a predetermined temperature by switching on/off the energization of said heating means based on said synchronous signal.

* * * * *